United States Patent [19]

Brodie

[11] 4,374,481

[45] Feb. 22, 1983

[54] ADJUSTABLE SOCKET WITH DETACHABLE OR LOCKABLE ENGAGING HANDLE COMPONENT

[76] Inventor: Michael Brodie, P.O. Box 64, Vilna, Alberta, Canada

[21] Appl. No.: 158,225

[22] Filed: Jun. 10, 1980

[30] Foreign Application Priority Data

Oct. 10, 1979 [GB] United Kingdom ..... 7935169

[51] Int. Cl.[3] ..... B25B 13/32

[52] U.S. Cl. ..... 81/115; 279/37; 279/57; 279/107

[58] Field of Search ..... 81/58.3, 111, 112, 115, 81/128; 279/37, 43, 50, 57, 71, 74, 107, 114

[56] References Cited

U.S. PATENT DOCUMENTS

| | | | |
|---|---|---|---|
| 2,667,801 | 2/1954 | Eaves | 81/58.3 |
| 2,671,367 | 3/1954 | Modin | 81/58.3 |
| 2,701,494 | 2/1955 | Johnson | 81/112 X |
| 3,115,913 | 12/1963 | Yess | 81/58.3 X |
| 3,272,246 | 9/1966 | Bohnet | 81/58.3 X |
| 3,996,821 | 12/1976 | Murray | 81/177 A |

FOREIGN PATENT DOCUMENTS

| | | | |
|---|---|---|---|
| 1038665 | 9/1978 | Canada | 81/115 |

*Primary Examiner*—James G. Smith
*Attorney, Agent, or Firm*—Stanley G. Ade

[57] ABSTRACT

The adjustable socket comprises a plurality of fingers pivoted by one end thereof to a socket body and enclosed within a partially rotatable shell covering the socket body. A spiral slot in the shell is engaged by a pin or the like extending from the body so that when the shell is partially rotated, the shell extends or retracts axially relative to the body portion thus opening or closing the distal ends of the fingers due to the engagement of the outer surfaces of the distal ends of the fingers with the curved inturned end of the shell. This shell and fingers can be detachably locked in the desired position. This enables the fingers to adjust in order to grasp or grip a nut or bolt within the size range governed by design parameters. A spring reacts between the shell and the body portion normally retracting the shell so that the fingers are in the widest position. A handle assembly is secured to the inner end of the body and may be connected to the body by means of a clutch assembly connected when the handle assembly is pushed downwardly towards the body portion against spring pressure. Alternatively, the clutch assembly may be detachably locked in engagement between the handle component and the body portion.

19 Claims, 19 Drawing Figures

FIG. 12
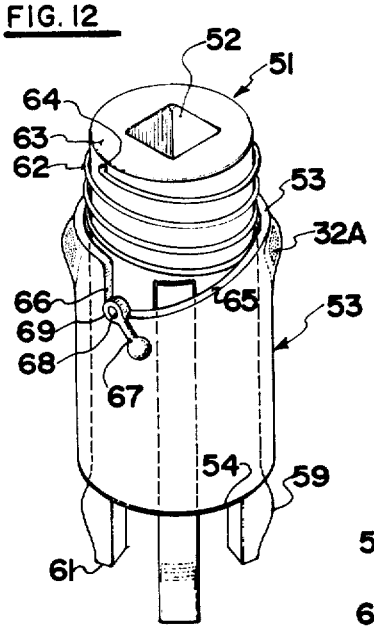
FIG. 13
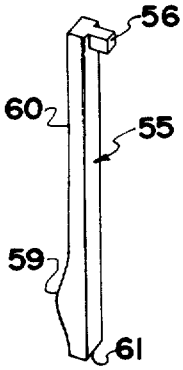
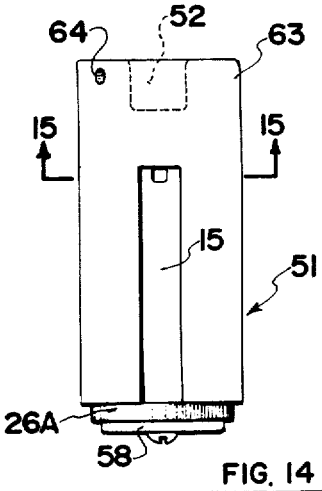
FIG. 14
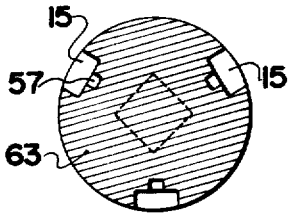
FIG. 15
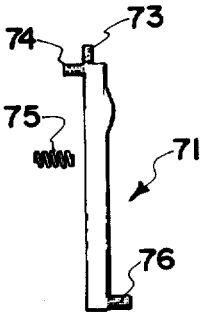
FIG. 18
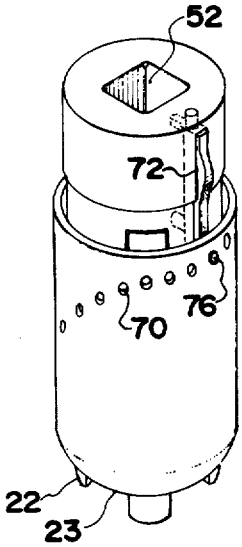
FIG. 16
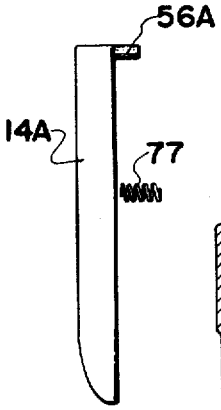
FIG. 17
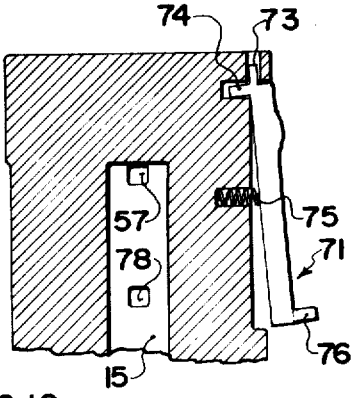
FIG. 19

ADJUSTABLE SOCKET WITH DETACHABLE OR LOCKABLE ENGAGING HANDLE COMPONENT

BACKGROUND OF THE INVENTION

This invention relates to new and useful improvements in adjustable socket assemblies, and in particular, to new and useful improvements in the socket assembly illustrated and described in Canadian Pat. No. 1038665, dated Sept. 19th, 1978.

In this particular patent, an adjustable socket assembly is shown whereby the rotation of an outer casing relative to the body portion thereof, causes a plurality of fingers to grip or release the side flats of a nut or bolt. A socket assembly of this particular patent is adapted to be engaged by a conventional socket or speed wrench.

Disadvantages have been found in this construction such as the difficulty in retracting the shell relative to the body and difficulty in utilizing the socket assembly in restricted areas where it may be difficult if not impossible to engage a conventional socket or speed wrench handle assembly with the socket assembly.

The present invention overcomes these disadvantages and in accordance with the invention there is provided an adjustable socket assembly for nuts and bolts comprising in combination a substantially cylindrical body portion, a plurality of bolt and nut gripping fingers pivoted by the inner ends thereof around said body portion and extending beyond the distal end thereof, an adjusting shell surrounding said body portion and said fingers, means mounting said shell for partial rotation around said body portion, said partial rotation extending and retracting said shell along said body portion, means cooperating between said shell and said body portion to extend and retract one relative to the other as said shell rotates, and means cooperating between said fingers and said shell to close and open the distal ends of said fingers relative to one another, and spring means operatively extending between said shell and said body portion normally urging said shell to retract relative to said body portion whereby said fingers are in the open position.

In accordance with a further aspect of the invention, there is provided, in an adjustable socket assembly for nuts and bolts, which includes a substantially cylindrical body portion a plurality of bolt and nut gripping fingers pivoted by the inner ends thereof around said body portion and extending beyond the distal end thereof, an adjusting shell surrounding said body portion and said fingers, means mounting said shell for partial rotation around said body portion, said partial rotation extending and retracting said shell along said body, and means cooperating between said shell and said body portion to extend and retract one relative to the other and further means cooperating between said fingers and said shell to close and open the other ends of said fingers relative to one another; the improvement comprising a handle component, means connecting said handle component to the upper end of said body portion and further means selectively and operatively connecting said handle component to said body portion for detachably locking said handle component to said body portion whereby rotation of said handle component in either direction, rotates said body portion and said shell in the same direction.

A further advantage of the present invention is the fact that the socket assembly is easily adjusted around the head of a nut or bolt and may be locked in position.

A further advantage is to provide a device of the character herewithin described in which, if desired, means are provided whereby the clutch assembly between the handle and body portion may be engaged by downward pressure of the handle so that it can be rotated in either direction or, alternatively, may be detachably secured in engagement with the body portion.

A still further advantage of the present invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

FIG. 12 is an isometric elevation of an alternative embodiment of the device.

FIG. 13 is an isometric view of one of the fingers used in the embodiment of FIG. 12.

FIG. 14 is a front elevation of the body portion per se of FIG. 12.

FIG. 15 is a section along the line 15—15 of FIG. 14.

FIG. 16 is an isometric elevation of a still further embodiment of the device.

FIG. 17 is an isometric view of one of the fingers of FIG. 16.

FIG. 18 is an isometric view of the locking lever per se used in FIG. 16.

FIG. 19 is a fragmentary cross sectional view of the upper end of the body portion of FIG. 16 with the locking lever engaged therein.

In the drawings like characters of reference indicate corresponding parts in the different figures.

DETAILED DESCRIPTION

Figure 1:
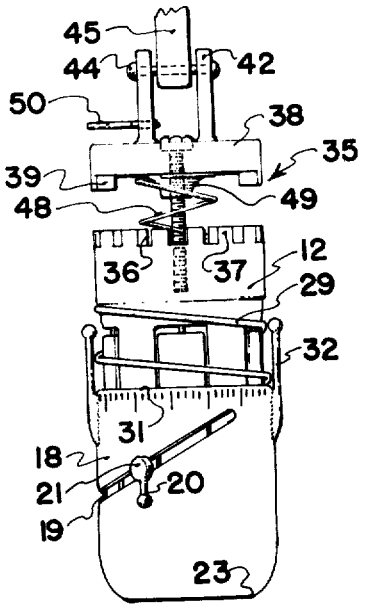
FIG. 1 is a partially exploded side elevation of the device.
Figure 7:
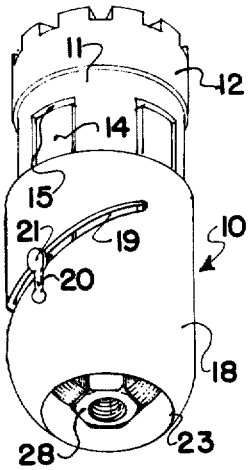
FIG. 7 is an isometric side elevation of the device showing the shell in the extended position and gripping a nut.
Figure 8:
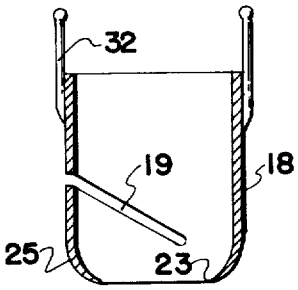
FIG. 8 is a vertical section of the shell per se.

Proceeding to describe the invention in detail, reference should first be made to the socket assembly collectively designated 10 and illustrated in FIGS. 1 and 7.

It consists of a cylindrical body portion 11 having an upper shouldered portion 12 and an inner cylindrical portion 13 extending axially therefrom.

A plurality of fingers 14 are pivoted within longitudinally extending slots 15 extending along the length of the portion 13, by means of axially extending pins 16 extending from the upper ends of the fingers 14 and engaging loosely within apertures 17 formed at the upper end of the slots 15 so that the fingers can pivot radially with respect to the portion 13 of the body portion.

A cylindrical sleeve 18 is rotatable and endwise movable within limits upon the body portion surrounding the fingers, said sleeve being provided with a curved closed ended slot 19 through the wall thereof engageable by a locking pin 20 screw threadably engageable into the portion 13 of the body portion and having a head 21 spanning the walls of the slot 19. The outer distal ends of the fingers are curved as illustrated by reference character 22 and the distal end 23 of the hollow shell curves inwardly so that the inner surface 24 of this distal end gradually decreases in diameter from the parallel wall portion 25 of the shell. This distal end 23 engages the curved surfaces 22 of the fingers so that when the shell is in the position shown in FIG. 9, the distal end 23 of the shell is situated slightly beyond the distal ends of the fingers. A triangular resilient member 26 is engaged in the distal end of the portion 13 of the body portion and the fingers are held against the corner portions 27 of this resilient member, by the inner wall of the shell 18. When the shell is fully extended (with the fingers being fully retracted) by partially rotating same upon the pin 20, the resilient member 26 expands the fingers to the widest position illustrated in FIG. 9.

Figure 10:
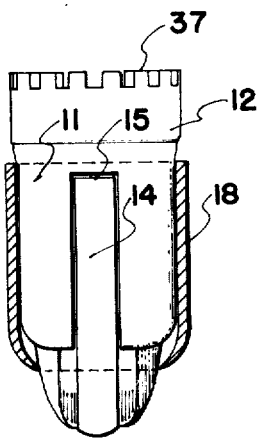
FIG. 10 is a view similar to FIG. 9 but showing the shell fully retracted.

However, as the shell is rotated to retract same relative to the body portion (with the fingers beginning to extend), the narrower extremity or distal end 23 of the shell rides the curved surfaces 22 of the fingers and gradually moves them towards one another radially so that the inner surfaces may close around a nut or bolt as indicated by reference character 28 in FIG. 7. The fully retracted position of the shell with the fingers in the closed position, as shown in FIG. 10.

Figure 9:
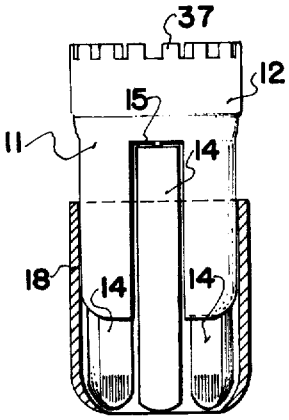
FIG. 9 is a side elevation of the socket assembly with the shell sectioned and showing the shell fully extended relative to the body portion.
Figure 11:
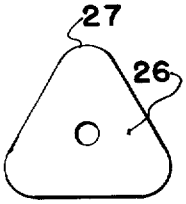
FIG. 11 is a top plan view of the preferred embodiment of the resilient member engaging the inner surfaces of the fingers.

A compression spring 29 extends around the upper portion of the body portion and reacts between the underside 30 of the shoulder 12 and the upper end 31 of the shell normally maintaining the shell in the fully extended position of FIG. 9 so that the distal ends of the fingers are in the widest position thus facilitating the engagement of same over the nut or bolt 28.

The body portion is held by one hand and the shell is rotated by the other to retract the shell thus closing the distal ends of the fingers 14 around the nut or bolt 28. In this connection upwardly extending projecting portions 32 on the inner end of the shell wall, may be grasped by the fingers of the operator. When in the position gripping the nut or bolt 28, and against pressure of spring 29, the locking member 20 is tightened thus locking the shell in position relative to the body portion.

It will be noted that the inner surfaces 33 of the distal ends of the fingers 14 may be striated to assist in gripping the flats of the nut or bolt 28.

It will also be noted that as the shell is retracted, the fingers are closed and compressed against the resilient member 26 which, of course, expands when the shell is extended thus forcing the fingers to the outermost position.

Means are provided to rotate in either direction, the socket assembly 10, said means taking the form of a handle component collectively designated 34. Means are also provided to detachably secure or detachably lock the handle assembly to the socket assembly 10 so that it can be rotated by the handle component 34, said last mentioned means being collectively designated 35.

Said last mentioned means takes the form of a clutch face 36 formed on the upper horizontal surface of the shoulder 12 of the body portion. In this embodiment, it comprises an outer ring of castellations 37 clearly illustrated in FIGS. 1 and 2.

A clutch engaging member 38 is provided with a plurality of castellation engaging projections 39 extending downwardly from the undersurface thereof. This clutch engaging member is mounted to the body portion for free rotation when not engaged with the clutch face 36 and for axial movement relative to the clutch member, said last mentioned means taking the form of a headed bolt 40. This headed bolt includes a screw threaded stem 41 passing freely through an aperture centrally located within the clutch engaging member 38 and being screw threadably engaged within a screw threaded aperture within the upper side of the shoulder 12.

A pair of lugs 42 extend upwardly from the upper surface 43 of the clutch engaging member and a pivot pin 44 pivotally connects one end of a link 45 between lugs 42. Link 45 forms part of the handle component 34. The upper portion of the handle component comprises the actuating portion 46 which in turn is pivotally connected by means of pin 47 to the other end of link 45 thus forming an articulated handle assembly.

Downward pressure of this handle assembly moves the clutch engaging member into engagement with the clutch member 36 thus enabling the handle assembly to rotate the socket assembly 10 in either direction.

A compression spring 48 surrounds a centrally located boss 49 depending from the underside of the clutch engaging member 38 and reacts between the upper surface of the body portion and the clutch engaging member normally maintaining it out of engagement with the clutch member 36. The aforementioned downward pressure of the handle assembly overcomes pressure of spring 48 and allows the portion 39 of the clutch engaging member to engage the castellations 37 of the clutch member 36.

In operation, the socket is sized as hereinbefore described and engaged over the nut or bolt 28 whereupon the handle is angulated by the articulation characteristics thereof to suit the conditions under which rotation of the nut or bolt is situated. Downward pressure engages the clutch component 35 so that rotation of the handle component 34 in either direction, rotates the socket assembly 10 in the same direction and release of this downward pressure causes spring 48 to separate the clutch component so that the handle can be returned to the original position and the clutch 35 re-engaged. This enables the handle assembly to operate the socket assembly in a manner similar to a conventional ratchet assembly but, of course, movement can be in either direction without the necessity of operating the normal ratchet assembly lever. Furthermore, because of the castellation formation 37 and 39, positive locking action between the two parts of the clutch assembly is assured with practically no chance of trouble occurring to the functional operation of the device.

Figure 2:
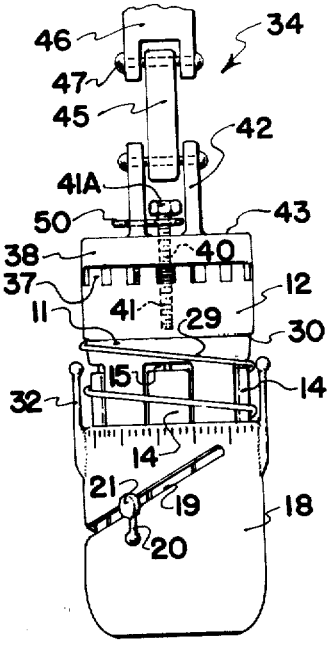
FIG. 2 is a view similar to FIG. 1 but showing the invention in the assembled position and also showing the clutch in the detachably locked position.
Figure 3:
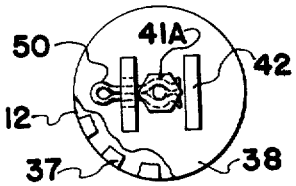
FIG. 3 is a top plan view of FIG. 2 with the handle component removed for clarity.
Figure 4:
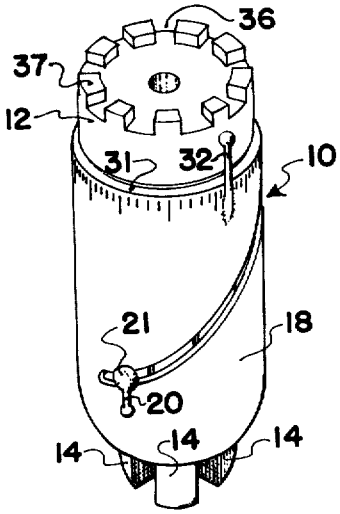
FIG. 4 is an isometric elevation of the body and shell components of the socket assembly.
Figure 5:
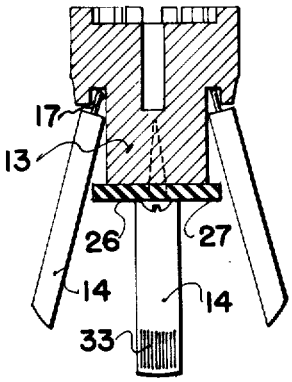
FIG. 5 is a side cross sectional elevation of the body portion and fingers per se.
Figure 6:
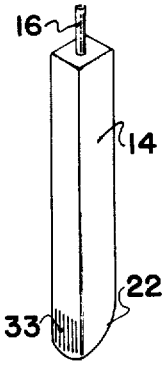
FIG. 6 is an isometric view of one of the fingers per se.

Under certain circumstances, it is desirable to lock the clutch assembly 35 in the closed position. Under these circumstances, the clutch engaging member 38 is moved downwardly against pressure of spring 48 whereupon a bifurcated cotter pin 50, engaged through an aperture in one of the lugs 42, is moved towards the opposite lug 42 so that the bifurcated legs engage under the head 41A of the bolt 41 mounting the clutch engaging member 38 to the head. This is shown in FIGS. 2 and 3 in the engaged position thus restricting the spring 48 for moving the clutch engaging member out of engagement with the castellations 37.

Outward movement of the cotter pin 50 to the position shown in FIG. 1, releases the head from the bifurcated legs thereof and allows the clutch to operate in the manner hereinbefore described.

It will therefore be appreciated that an adjustable socket assembly is provided which is easily engaged upon a nut or bolt and adjusted to the correct size whereupon it may be locked in position.

It will also be appreciated that the articulation of the handle component 34 permits operation of the socket assembly under close or confined conditions and that the handle may rotate the socket assembly in either direction without the necessity of operating ratchet levers as is conventional.

It will be appreciated that, if desired, the handle assembly may be detachably locked into engagement with the socket assembly by means of the cotter pin 50.

Describing next, the embodiment illustrated in FIGS. 12–15, where applicable, similar reference characters have been utilized.

In this embodiment, the cylindrical body portion collectively designated 51 is provided preferably with a square cross sectioned aperture 52 in the upper end thereof adapted to receive a conventional ratchet drive (not illustrated).

The cylindrical shell collectively designated 53 is provided with a cylindrical lower end 54 having the same diameter as the diameter of the shell and this shell engages over the body portion 51 in a similar manner to that hereinbefore described.

However, the fingers collectively designated 55, are slightly different in configuration. These fingers are provided with an inturned lug 56 on the upper end thereof engageable within radially situated apertures 57 formed in the body portion at the upper end of the vertical slots 15 formed in the major portion of the body portion similar to the embodiment hereinbefore described and the fit of these lugs 56 within the apertures 57 is such that the fingers can pivot radially outwardly around the lugs 56 being normally urged outwardly by a substantially triangular resilient member 26A similar to member 26 but in this embodiment, engaged over the lower shouldered end 58 of the body portion 51.

Each finger is provided with a cam surface 59 on the outer side 60 thereof situated towards the distal ends 61 of the fingers, but spaced upwardly therefrom and these cam surfaces are engaged by the inner wall of the lower end 54 of the shell 53 as the shell is moved relative to the body portion.

A coil compression spring 62 surrounds the upper end portion 63 of the body portion and is secured by one end thereof to the body portion by means of pin 64.

The other end of the spring reacts against the upper end of the shell 53 and normally urges it to the fully extended position with the fingers retracted within the shell.

Means are provided to adjust the relative positions of the shell and the body portion and take the form of a sloping ramp 65 formed in the wall of the shell and extending from the upper edge 53 thereof downwardly and around to a point indicated by reference character 66.

A locking lever 67 extends from a screw threaded member 68 which screw threadably engages an aperture within the body portion 51 and the screw rides on the ramp 65. Projecting portions 32A, similar to portions 32, extend upwardly adjacent the upper end of the shell and permit the shell to be rotated relative to the body portion when the locking screw 67 is loosened. When the desired relationship of the shell relative to the body portion is obtained, the lever is actuated thus locking the shell firmly in position to the body portion due to the overlapping portion 69 of the inner end of the lever 67, clamping against the outer surface of the shell.

As the shell is moved relative to the body portion, the cams 59 engaging with the inner surface of the lower end 54 of the shell, moves the fingers inwardly and outwardly and clamps them firmly in position around a nut or bolt engaged thereby. This particular embodiment is especially suited for use with members such as spark plugs which require clearance above the nut portion of the spark plug to receive the porcelain upper end (not illustrated).

The embodiment shown in FIGS. 16–19 is similar in operation to the embodiment illustrated in FIGS. 1 to 10 with the exception that the fingers 14A are provided with a lug 56A similar to lug 56 of FIG. 13 and which engages within apertures similar to apertures 57 illustrated in FIGS. 15 and 19. The fingers ride in vertical slots 15 in a manner hereinbefore described and operate in a similar manner being moved inwardly and outwardly by the engagement of the curved lower end 23 of the shell with the camming surfaces 22 on the lower ends of the fingers.

However, the method of adjusting the relative position of the shell with the body portion is different in this embodiment, giving a more positive locking action so that this particular embodiment may be used either with conventional ratchet wrenches or with an impact wrench.

A plurality of apertures or drillings 70 are formed through the wall of the shell adjacent the upper end 53 thereof and this row of apertures extends from adjacent the upper edge, partially around the shell and inclining downwardly from the upper edge as clearly shown in FIG. 16.

A locking lever collectively designated 71 is illustrated in FIG. 18 and engages within a relatively short vertically situated slot 72 formed in the body portion adjacent the upper end thereof. Projecting portions 73 and 74 engage similar apertures at the upper end of slot 72 and permit the locking lever to move radially pivoting around the upper end thereof and being retained in position by means of the shell which extends thereover. A small spring 75 reacts between the body portion and the lever 71 normally urging same outwardly and an outwardly extending lug 76 on the lower end of the locking lever 71, engages any one of the apertures 70 depending upon the position of the shell relative to the body portion thus detachably locking the shell firmly in the desired location.

This enables a positive locking relationship to exist between the shell and the body portion and maintains the distal ends of the fingers in the desired relationship around the associated nut, bolt or the like.

Finally, it should be noted that preferably, a small compression spring 77 is provided for each finger seated within a small recess 78 within the base of the relevant slot 15 and this small spring normally biases the fingers outwardly and takes the place of the resilient triangular member 26 illustrated in the previous embodiment.

It will be appreciated that the present device can be used under many circumstances, but that it is particularly suitable for use in garages and the like due to the flexibility of the adjustable socket assembly.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. An adjustable socket assembly for nuts and bolts comprising in combination a substantially cylindrical body portion, a plurality of bolt and nut gripping fingers pivoted by the inner ends thereof around said body portion and extending beyond the distal end thereof, an adjusting shell surrounding said body portion and said fingers, means mounting said shell for partial rotation around said body portion, said partial rotation extending and retracting said shell along said body portion, means cooperating between said shell and said body portion to extend and retract one relative to the other as said shell rotates, means cooperating between said fingers and said shell to close and open the distal ends of said fingers relative to one another, and spring means operatively extending between said shell and said body portion normally urging said shell to extend and rotate relative to said body portion whereby said fingers are in the full open position, said body portion including a shoulder formed on the inner end thereof, said spring means surrounding said body portion and reacting between the underside of said shoulder and the inner end of said, a handle component, a connector for connecting said handle component to the upper end of said body portion and further means selectively and operatively connecting said handle component to said body portion for detachably engaging said handle component to said body portion whereby rotation of said handle component in either direction, rotates said body portion and said shell in the same direction, said further means comprising a clutch member on the upper side of said shoulder, a clutch engaging member journalled for free rotation by said connector upon the upper side of said shoulder facing said clutch member, spring means normally urging said clutch member and said clutch engaging member apart, said handle component being operatively connected to said clutch engaging member, downward pressure of said clutch engaging member overcoming said last mentioned spring means and detachably engaging said clutch engaging member with said clutch member whereby rotation of said handle in either direction rotates said body portion and said shell in the same direction, and means selectively engageable between said clutch engaging member and said connector to selectively lock said clutch engaging member into engagement with said clutch member.

2. The assembly according to claim 1 in which said connector comprising a headed bolt engaging freely through the clutch engaging member and securing into said shoulder, said clutch engaging member moving axially upon said bolt when moving into and out of engagement with said clutch member.

3. The assembly according to claim 2 in which said means selectively engageable between said clutch engaging member and said connector comprises a pin slidably engageable through said clutch engaging member and engaging under said headed bolt to restrict disengaging movement of said clutch engaging member relative to said clutch member.

4. The assembly according to claims 1, 2 or 3 in which said handle component comprises a main actuating portion, a link pivotally attached by one end thereof to one end of said actuating portion, and means pivoting the other end of said link to said other side of said clutch engaging member thereby forming an articulated handle component.

5. The improvement according to claim 1 in which said means selectively engageable between said clutch engaging member and said connector comprises a pin slidably engageable through said clutch engaging member and operatively engaging with said connector to restrict disengaging movement of said clutch engaging member relative to said clutch member.

6. The assembly according to claim 1 in which said means cooperating between said shell and said body portion to extend one relative to the other, includes at least one ramp surface extending downwardly and partially around said shell portion from the upper edge thereof, and means extending from said body portion and riding said ramp, to detachably lock said shell relative to said body portion at any position of said last mentioned means along said ramp.

7. The assembly according to claim 1 in which said means cooperating between said fingers and said shell to close and open the distal ends of said fingers relative to one another includes cam surfaces formed on the outer surfaces of said fingers adjacent the distal ends thereof engaging the lower perimeter of said shell whereby relative movement of said shell and said cams moves said fingers inwardly and outwardly.

8. The assembly according to claim 6 in which said means cooperating between said fingers and said shell to close and open the distal ends of said fingers relative to one another includes cam surfaces formed on the outer surfaces of said fingers adjacent the distal ends thereof engaging the lower perimeter of said shell whereby relative movement of said shell and said cams moves said fingers inwardly and outwardly.

9. The assembly according to claim 1 which includes means to detachably lock said shell relative to said body portion in any one of a plurality of positions, said last mentioned means including a plurality of apertures formed through the wall of said shell in a line inclining downwardly and around said shell from adjacent the upper ends thereof to partially around said shell and a locking lever pivoted by the upper end thereof to said body portion, spring means between said locking lever and said body portion normally urging the distal end of said locking lever outwardly and means on the distal end of said locking lever engageable within any one of said apertures through the wall of said shell.

10. In an adjustable socket assembly for nuts and bolts, which includes a substantially cylindrical body portion a plurality of bolt and nut gripping fingers pivoted by the inner ends thereof around said body portions and extending beyond the distal end thereof, an adjusting shell surrounding said body portion and said fingers, means mounting said shell for partial rotation around said body portion, said partial rotation extending and retracting said shell along said body, and means cooperating between said shell and said body portion to extend and retract one relative to the other and further means cooperating between said fingers and said shell to close and open the other ends of said fingers relative to one another; the improvement comprising a handle component, a connector connecting said handle component to the upper end of said body portion and further means selectively and operatively connecting said handle component to said body portion for detachably engaging said handle component to said body portion whereby rotation of said handle component in either direction, rotates said body portion and said shell in the same direction, said further means comprising a clutch member on the upper side of said shoulder, a clutch engaging member journalled for free rotation by said connector upon the upper side of said shoulder facing said clutch member, spring means normally urging said clutch member and said clutch engaging member apart, said handle component being operatively connected to said clutch engaging member, downward pressure of said clutch engaging member overcoming said last mentioned spring means and detachably engaging said clutch engaging member with said clutch member as aforesaid, said means connecting said handle component to the other end of said body portion including means pivotally connecting said handle component to said clutch engaging member, and means selectively engageable between said clutch engaging member and said connector to selectively lock said clutch engaging member into engagement with said clutch member, said connector journalling said clutch engaging member for free rotation to the upper side of said shoulder comprising a headed bolt engaging freely through the clutch engaging member and securing into said shoulder, said clutch engaging member moving axially upon said bolt when moving into and out of engagement with said clutch member.

11. The improvement according to claim 10, in which said handle component comprises a main actuating portion, a link pivotally attached by one end thereof to one end of said actuating portion, and means pivoting the other end of said link to said other side of said shoulder thereby forming an articulated handle component.

12. The improvement according to claim 10 in which said means selectively engageable between said clutch engaging member and said connector comprises a pin slidably engageable through said clutch engaging member and engaging under the head of bolt to restrict disengaging movement of said clutch engaging member relative to said clutch member.

13. An adjustable socket assembly for nuts and bolts comprising in combination a substantially cylindrical body portion, a plurality of bolt and nut gripping fingers pivoted by the inner ends thereof around said body portion and extending beyond the distal end thereof, an adjusting shell surrounding said body portion and said fingers, means mounting said shell for partial rotation around said body portion, said partial rotation extending and retracting said shell along said body portion, means cooperating between said shell and said body portion to extend and retract one relative to the other said shell rotates, means cooperating between said fingers and said shell to close and open the distal ends of said fingers relative to one another, means to detachably lock said shell relative to said body portion in any one of a plurality of positions, said last mentioned means including a plurality of apertures formed through the wall of said shell in a line inclining downwardly and around said shell from adjacent the upper ends thereof to partially around said shell and a locking lever pivoted by the upper end thereof to said body portion, spring means between said locking lever and said body portion normally urging the disend of said locking lever outwardly and means on the distal end of said locking lever engageable within any one of said apertures through the wall of said shell.

14. The assembly according to claim 13 which includes a handle component, a connector for connecting said handle component to the upper end of said body portion and further means selectively and operatively connecting said handle component to said body portion for detachably engaging said handle component to said body portion whereby rotation of said handle component in either direction, rotates said body portion and said shell in the same direction.

15. The assembly according to claim 14 in which said further means comprises a clutch member on the upper side of said shoulder, a clutch member journalled for free rotation by said connector upon the upper side of said shoulder facing said clutch member, spring means normally urging said clutch member and said clutch engaging member apart, said handle component being operatively connected to said clutch engaging member, downward pressure of said clutch engaging member overcoming said last mentioned spring means and detachably engaging said clutch engaging member with said clutch member as aforesaid.

16. The assembly according to claim 15 which includes means selectively engageable between said clutch engaging member and said connector to selectively lock said clutch engaging member into engagement with said clutch member.

17. The assembly according to claim 16 in which said means selectively engageable between said clutch engaging member and said connector comprises a pin slidably engageable through said clutch engaging member and operatively engaging said connector to restrict disengaging movement of said clutch engaging member relative to said clutch member.

18. The assembly according to claims 14, 15 or 16 in which said handle component comprises a main actuating portion, a link pivotally attached by one end thereof to one end of said actuating portion, and means pivoting the other end of said link to said other side of said clutch engaging member thereby forming an articulated handle component.

19. The assembly according to claim 17 in which said handle component comprises a main actuating portion, a link pivotally attached by one end thereof to one end of said actuating portion, and means pivoting the other end of said link to said other side of said clutch engaging member thereby forming an articulated handle component.

* * * * *